US011974669B1

(12) United States Patent
Klein

(10) Patent No.: US 11,974,669 B1
(45) Date of Patent: May 7, 2024

(54) HEIGHT-ADJUSTABLE DESK AND TELESCOPIC POSTS THEREOF

(71) Applicant: Gregory Klein, Brooklyn, NY (US)

(72) Inventor: Gregory Klein, Brooklyn, NY (US)

( * ) Notice: Subject to any disclaimer, the term of this patent is extended or adjusted under 35 U.S.C. 154(b) by 0 days.

(21) Appl. No.: 18/381,620

(22) Filed: Oct. 18, 2023

Related U.S. Application Data

(60) Provisional application No. 63/380,085, filed on Oct. 19, 2022.

(51) Int. Cl.
*A47B 9/04* (2006.01)

(52) U.S. Cl.
CPC ..... *A47B 9/04* (2013.01); *A47B 2009/046* (2013.01)

(58) Field of Classification Search
CPC ..... A47B 9/04; A47B 9/20; A47B 2009/046
See application file for complete search history.

(56) References Cited

U.S. PATENT DOCUMENTS 5,224,429 A * 7/1993 Borgman ..... A47B 17/033 248/188.4
10,524,564 B1 * 1/2020 Wu ..... A47B 9/20
10,531,732 B1 * 1/2020 Huang ..... F16B 7/14
10,758,036 B2 * 9/2020 Lu ..... A47B 9/04
11,305,971 B2 * 4/2022 Liu ..... A47B 9/20
2018/0140087 A1 * 5/2018 Wu ..... F16H 25/2056
2018/0172062 A1 * 6/2018 Hu ..... F16H 25/2056
2019/0357668 A1 * 11/2019 Knudtson ..... A47B 9/04
2020/0268145 A1 * 8/2020 Seal ..... A47B 21/02
2021/0321760 A1 * 10/2021 Windhaber ..... A47B 9/04
2022/0243793 A1 * 8/2022 Hu ..... F16H 25/2454
2023/0029425 A1 * 1/2023 Lin ..... A47B 9/20

* cited by examiner

*Primary Examiner* — Daniel J Rohrhoff
(74) *Attorney, Agent, or Firm* — Innovent Law, P.C; Karima Gulick

(57) ABSTRACT

The height adjustable desk according to the present disclose includes a work surface and at least one telescopic leg attached to the work surface. The telescopic leg has a motor, a gear set, a first rotator, and a second rotator. The gear set has a first gear connected to the motor and a second gear engaged with the first gear, wherein the motor transfers force to the second gear through the first gear. The first rotator is engaged with the second gear and the second rotator engaged with the first rotator. The motor rotates the first rotator through the gear set so that the first rotator can translate along a length of the second rotator. The first gear is located above the motor and the second gear is located above the first rotator.

20 Claims, 10 Drawing Sheets

HEIGHT-ADJUSTABLE DESK AND TELESCOPIC POSTS THEREOF

CROSS-REFERENCE TO RELATED APPLICATION

This application incorporates by reference and claims the benefit of priority to U.S. Provisional Application 63/380,085 filed on Oct. 19, 2022.

BACKGROUND OF THE INVENTION

1. Field of the Invention

This invention relates generally to an adjustable height table. More particularly, the invention relates to a desk having extended and adjustable range that allows the user to adjust the height of the table to ergonomically work while seated on the floor, seating in a chair, while standing, and in any other configuration in between.

2. Description of the Related Art

Existing adjustable-height tables provide the users with different ergonomic configurations to perform their work. For health and productivity considerations, the user can switch between different positions that allows the user to work while sitting in a chair, seated on the floor, or in a standing position.

There are many adjustable-height tables on the market as well as many floor sitting tables on the market, but there are no existing work surfaces offering different configurations that allow the user to work while seated on the floor, seating in a chair, while standing, and in any other configuration in between.

Therefore, a need exists for adjustable-height tables having various configurations that allow the user to work while seated on the floor, seating in a chair, while standing, and in any other configuration in between.

BRIEF DESCRIPTION OF THE DRAWINGS

It should be noted that the drawing figures may be in simplified form and might not be to precise scale.

DETAILED DESCRIPTION OF THE INVENTION

New technology for an adjustable height table mechanism with extended range including a cover mechanism and multi-stage actuated lift mechanism are discussed herein. In the following description, for purposes of explanation, numerous specific details are set forth to provide a thorough understanding of the present invention.

The embodiment and various other embodiments can be better understood by turning to the following detailed description, which are presented as illustrated examples defined in the claims. It is expressly understood that the embodiment as defined by the claims may be broader than the illustrated embodiments described below. Many alterations and modifications may be made by those having ordinary skill in the art without departing from the spirit and scope of the embodiments.

Figure 1:
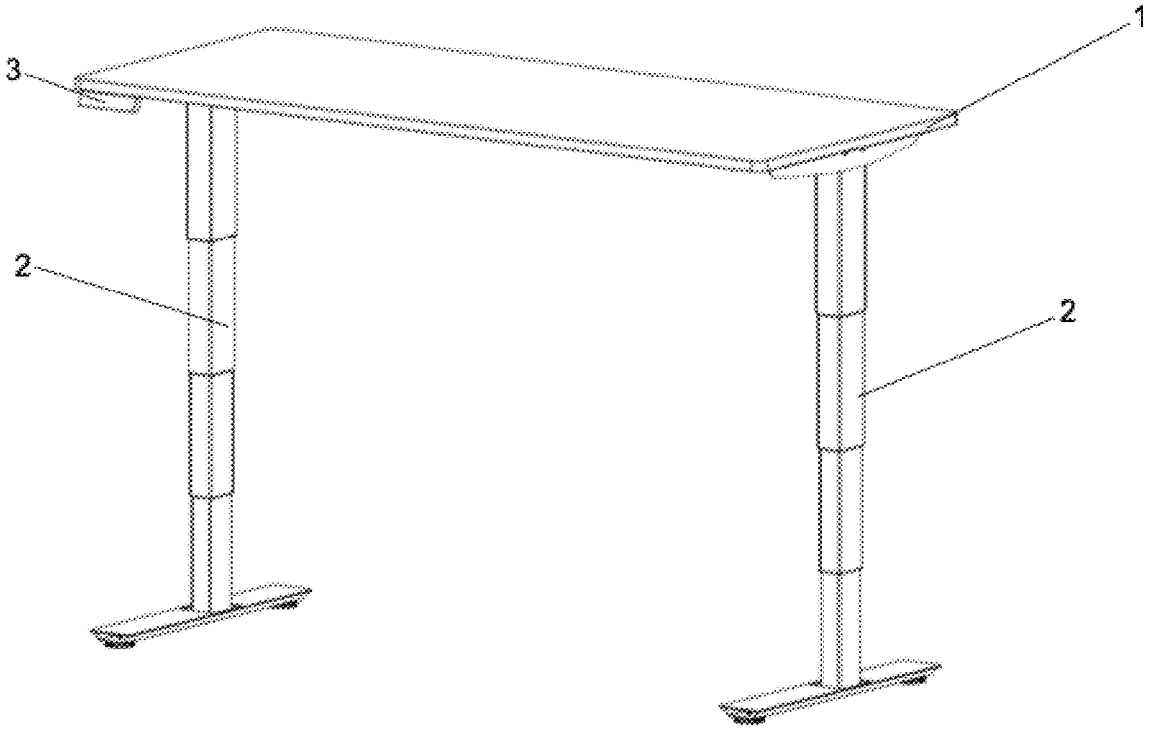
FIG. 1 is a perspective view of a height-adjustable desk according to one embodiment of the present disclosure.
Figure 2:
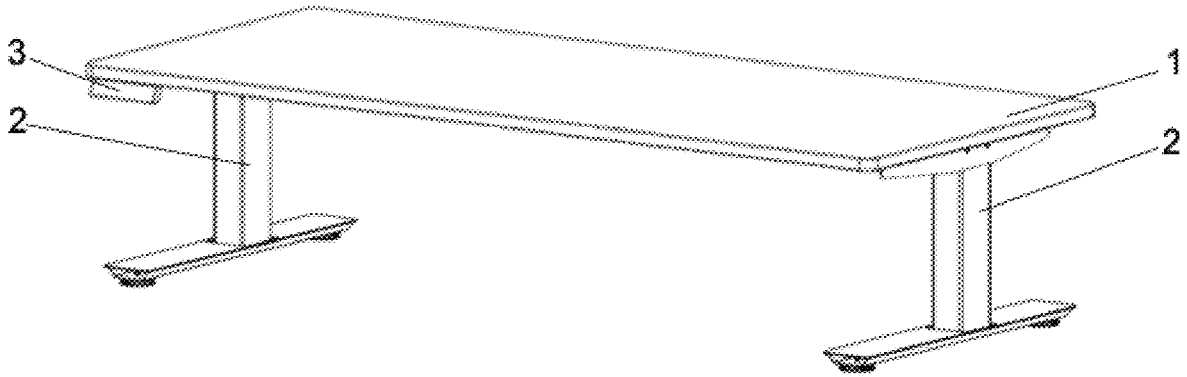
FIG. 2 is another perspective view of the adjustable desk, wherein the two telescopic legs are collapsed to fully retract the height-adjustable desk and minimize its height.

The present invention will now be described by referencing the appended figures that represent the preferred embodiments. FIG. 1 is a perspective view of a height-adjustable desk according to one embodiment of the present disclosure. The height-adjustable desk includes a work surface 1, two telescopic legs 2 attached to the work surface 1, and a control panel 3. FIG. 2 is another perspective view of the adjustable desk, wherein the two telescopic legs are collapsed to fully retract the height-adjustable desk and reduce its height.

In the present embodiment, the work surface 1 is mounted to the two telescopic legs 2 by wood screws or machine screws to embedded metal inserts in the work surface 1. The height of the height-adjustable desk is controlled by the control panel 3 attached to the worksurface 1. The control panel 3 is electrically connected to the motors (not illustrated) of the two telescopic legs 2. A user controls the motors by using control panel's 3 input devices such as buttons with up/down indicators for adjusting the height of the desk as well as a pre-programmed button that will return the desk to a pre-programmed position. The above-mentioned up/down indicators includes arrows, words, or any other suitable indicators of direction.

Figure 3:
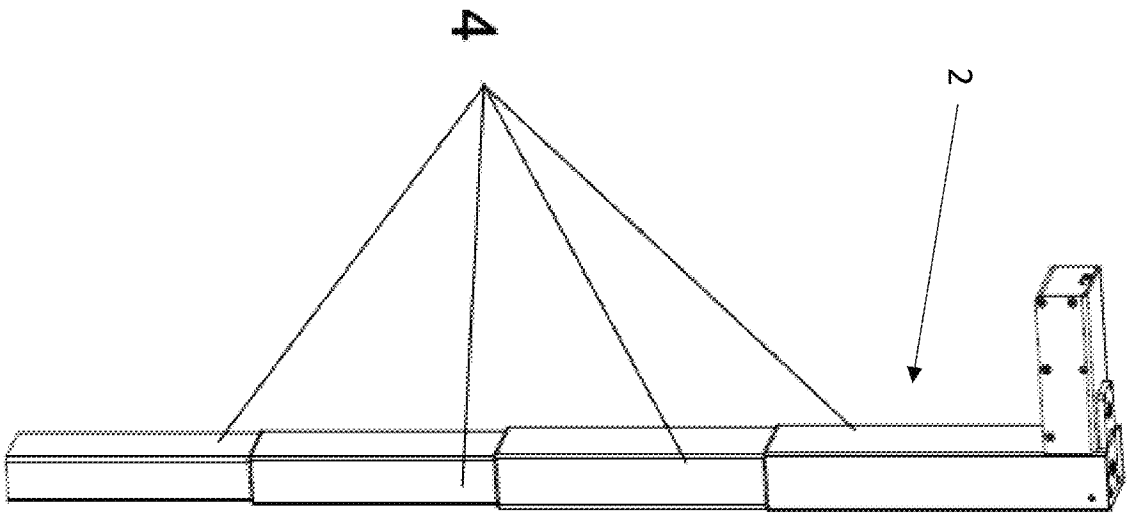
FIG. 3 is a perspective view of an extended telescopic leg according to one embodiment of the present disclosure.

FIG. 3 is a perspective view of a telescopic leg 2 according to one embodiment of the present disclosure. The telescopic leg 2 includes a plurality of sections and a plurality of covers 4 attached to each section. The cover 4 functions to protect the user from pinching or shearing during height adjustment of the height-adjustable desk. The cover 4 consists of a number of segments, wherein segments differ in sizes to ensure that they are nested as the leg 2 is retracted. Preferably, as illustrated in FIG. 3, the sizes of the cover 4 segments can be arranged in a descending or ascending order. In other words, the cover 4 segment at the top can be smaller or greater in size than the cover 4 segment immediately below. Similarly, the cover 4 segment second from the top can be smaller or greater in size than the cover 4 segment immediately below.

Figure 4:
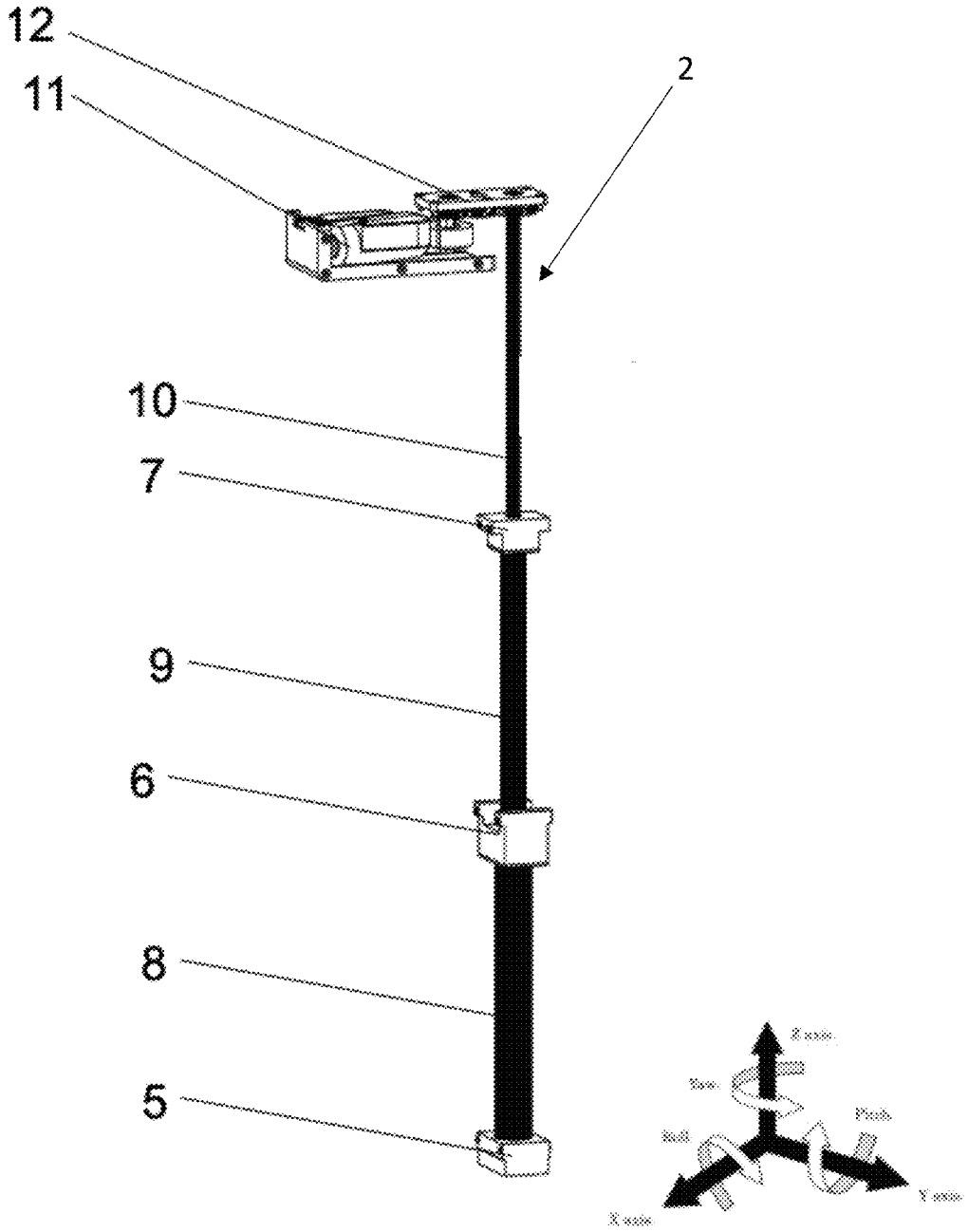
FIG. 4 is a perspective view of the extended telescopic leg with the covers removed.

FIG. 4 is a perspective view of the telescopic leg 2 with the covers 4 removed therefrom. In the present embodiment, the telescopic leg 2 adjusts the height of the desk in the Z-direction. On the other hand, the covers 4 restrict motion in the other 5 Degrees of Freedom, translation in X-direction, Y-direction and rotation in the pitch, roll and yaw axes.

The telescopic leg 2 adjusts the height of the desk in the Z-direction, The telescopic leg 2 includes a plurality of nested lead screws, 8, 9, 10 and lead nuts 5, 6, 7, wherein the lead screws 8, 9, 10 can be simultaneously rotated to move in the Z-direction by interacting with the lead nuts, 5, 6, 7. The adjacent lead screws 8, 9, 10 have corresponding key profiles that allow one lead screw to rotate the lead screw immediately below. The keyed profiles that connect adjacent lead screws will be further explained below.

The telescopic leg 2 includes a motor 11, a gear set 12, a first lead screw 10, a second lead screw 9, a third lead screw 8, a first lead nut 7, a second lead nut 6, and a third lead nut 5. In the present embodiment, the telescopic leg 2 includes four stages of movement, wherein three of the stages each involves a pair of lead screw and lead nut. Stage A of the telescopic leg 2 movement involves using the motor 11 and the gear set 12 to drive and rotate the first lead screw 10. Stage B of the telescopic leg 2 movement involves the first lead screw 10, the second lead screw 9, and the first lead nut 7. Stage C of the telescopic leg 2 movement involves the second lead screw 9, the third lead screw 8, and the second lead nut 6. Stage D of the telescopic leg 2 movement involves the third lead screw 8.

Figure 5:
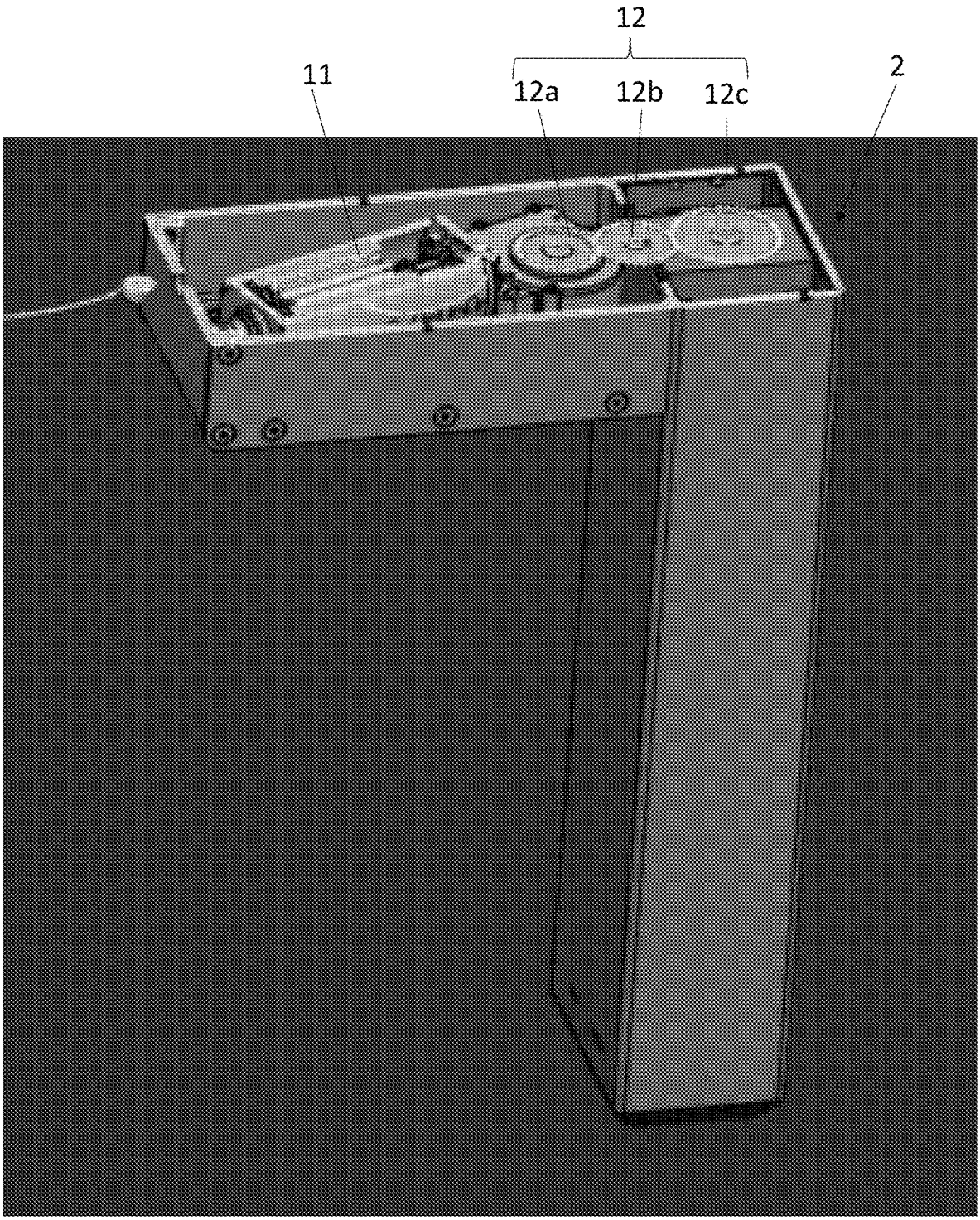
FIG. 5 is a perspective view of a retracted telescopic leg according to one embodiment of the present disclosure
Figure 6:
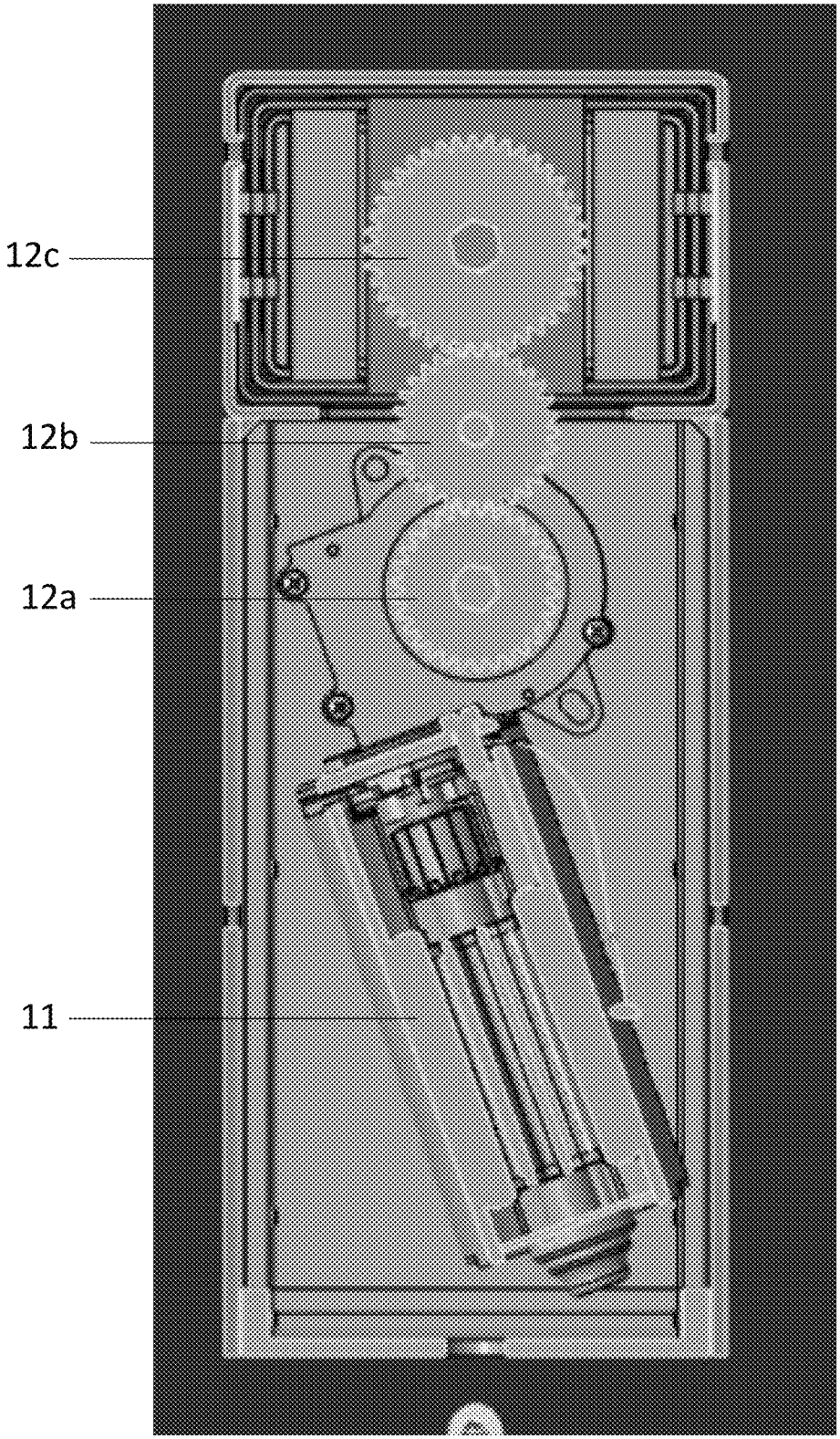
FIG. 6 is a top view of the retracted telescopic leg according to one embodiment of the present disclosure.
Figure 7:
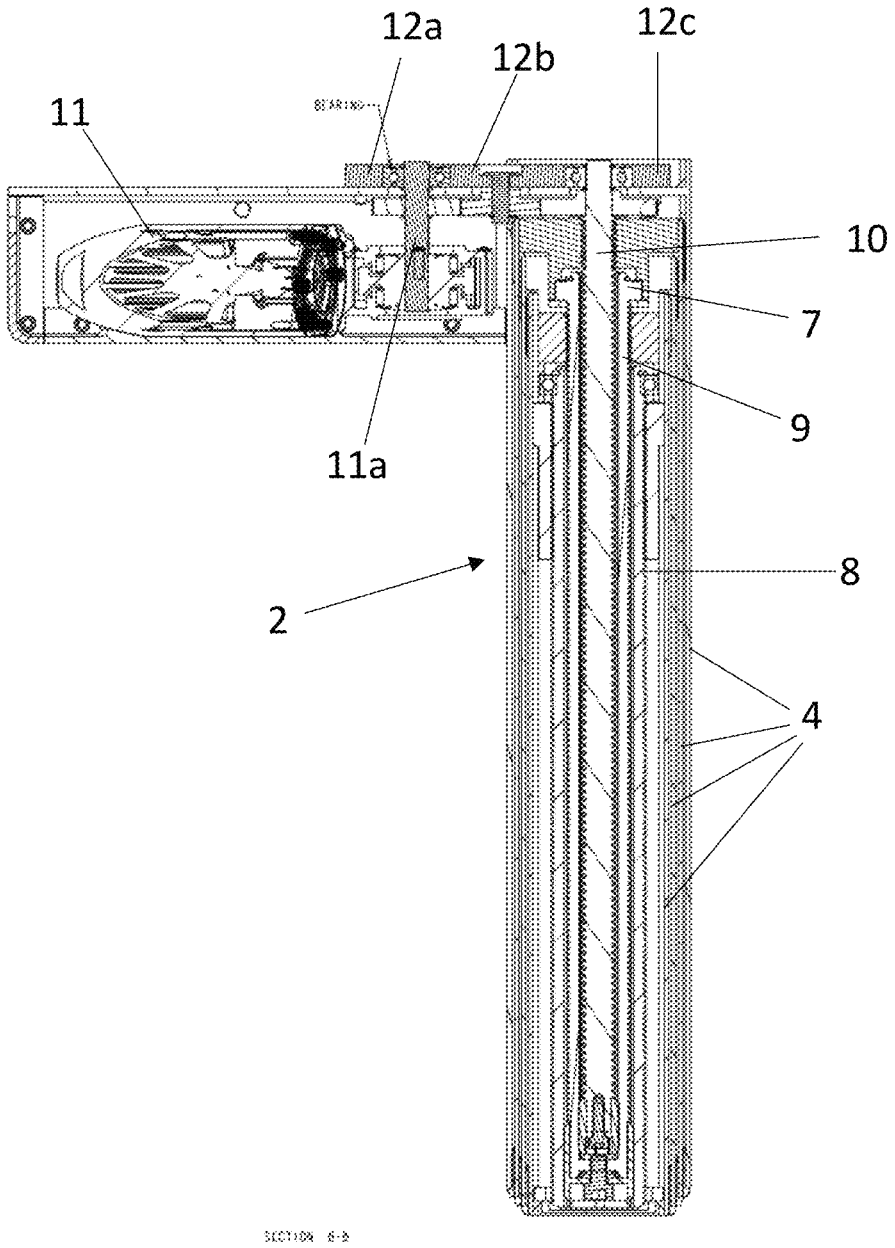
FIG. 7 is a cross-sectional view of the retracted telescopic leg according to one embodiment of the present disclosure.

FIGS. 5-7 are respectively a perspective view, a top view, and a cross-sectional view of a fully retracted telescopic leg 2 according to one embodiment of the present disclosure. As illustrated in FIGS. 5-6, the motor 11 is outside the vertical profiles of the lead screws 8, 9, 10 and the gear set 12. Typical standing desks legs have the motor stacked on top of the telescopic leg which won't allow for the low height that the telescopic leg 2 of the present disclosure is capable of reaching. To make the height of the retracted height-adjustable desk as low as possible, the motor 11 is thus moved outside the profile of the telescopic legs 2 and gear set 12, wherein gears, chains, belts or other power transmission devices can be used to transfer mechanical power from the motor 11 to the lead screws 8, 9, 10.

As illustrated in FIGS. 5-6, stage A of the telescopic leg 2 movement involves the motor 11 and the gear set 12, wherein the gear set 12 includes a first gear 12*a* coupled with the motor 11, a second gear 12*b* coupled with the first gear 12*a*, and a third gear 12*c* coupled with the second gear 12*b*. The gears 12*a*, 12*b*, 12*c* of the present embodiment are spur gears but are not limited thereto. In different embodiments, the gear set 12 can include other types of gears such as helical gears, skew gears, double helical gears, bevel gears, spiral bevels gears, hypoid gears, crown gears, worm gears, non-circular gears, racks and pinions, epicyclic gear trains, sun-and-planet gears, harmonic gears, cage gears, cycloidal gears, magnetic gears, etc.

The motor 11 of the present embodiment is an electric motor that converts electrical energy into mechanical energy to drive the gears of the gear set 12. The motor 11 can be powered by various direct current (DC) sources, such as from batteries, or rectifiers, or by alternating current (AC) sources, such as a power grid, inverters or electrical generators. Further, the motor 11 includes different constructions such as brushed electric motors, brushless electric motors, single-phase electric motors, two-phase electric motors, three-phase electric motors, axial flux electric motors, and radial flux electric motors. The motor 11 of the present embodiment is configured to produce rotary force (torque) intended to drive and rotate the gears 12*a*, 12*b*, 12*c* of the gear set 12.

As illustrated in FIG. 7, the motor 11 has a shaft 11*a* configured to couple with the first gear 12*a*. As illustrated in FIGS. 5-7, the second gear 12*b* is coupled with both the first gear 12*a* and the third gear 12*c*. When a user uses the control panel 3 (illustrated in FIG. 1) to instruct the telescopic leg 2 to expand, the control panel 3 will direct electrical energy from a AC or DC source to rotate its shaft 11*a* which in turn rotate the first gear 12*a*. The first gear 12*a* then transfer the mechanical energy from the motor 11 to the second gear 12*b* which then transfer the mechanical energy to the third gear 12*c*. As illustrated in FIG. 7, the third gear 12*c* is coupled with the first lead screw 10 below and thus will use the mechanical energy from the motor 11 to rotate the first lead screw 10. This initiates stage B of the telescopic leg 2 movements which will be further explained below.

In the embodiment illustrated in FIGS. 4 and 7, the first lead nut 7 is attached to one end of the second lead screw 9. The first lead nut 7 has an opening configured to fit the first lead screw 10. In other words, the opening of the first lead nut 7 and the first lead screw 10 have substantially the same circumferences and radii. Further, the inner surface of the opening of the first lead nut 7 and the outer surface of the first lead screw 10 are both configured to have corresponding threads. Preferably, the inner surface of the opening of the first lead nut 7 and the outer surface of the first lead screw 10 have substantially matching thread pitch and lead. Before the first lead screw 10 is rotated by the motor 11 and the gear set 12, the first lead nut 7 is fixed to the covers 4 to prevent the first lead nut 7 from being rotated by the rotating first lead screw 10. In this way, the threads of first lead screw 10 can interact with the threads of the first lead nut 7 to move the first lead screw 10 vertically up and down as it rotates.

Also, as illustrated in FIGS. 4 and 7, the gear set 12 is located above both the first lead screw 10 and the motor 11. The gear set 12 allows the motor 11 to be located right next to the first lead screw 10 and drives the first lead screw 10 without having to be directly above it. The thickness of the motor 11 is much greater than that of the gear set 12. Accordingly, the lowest attainable height of the work surface 1 can be further reduced by the difference in thickness between the motor 11 and the gear set 12. Also, in a different embodiment, the motor 11 can be disposed above the gear set 12, wherein the shaft 11*a* of the motor 11 is still coupled with the first gear 12*a*.

Figure 8:
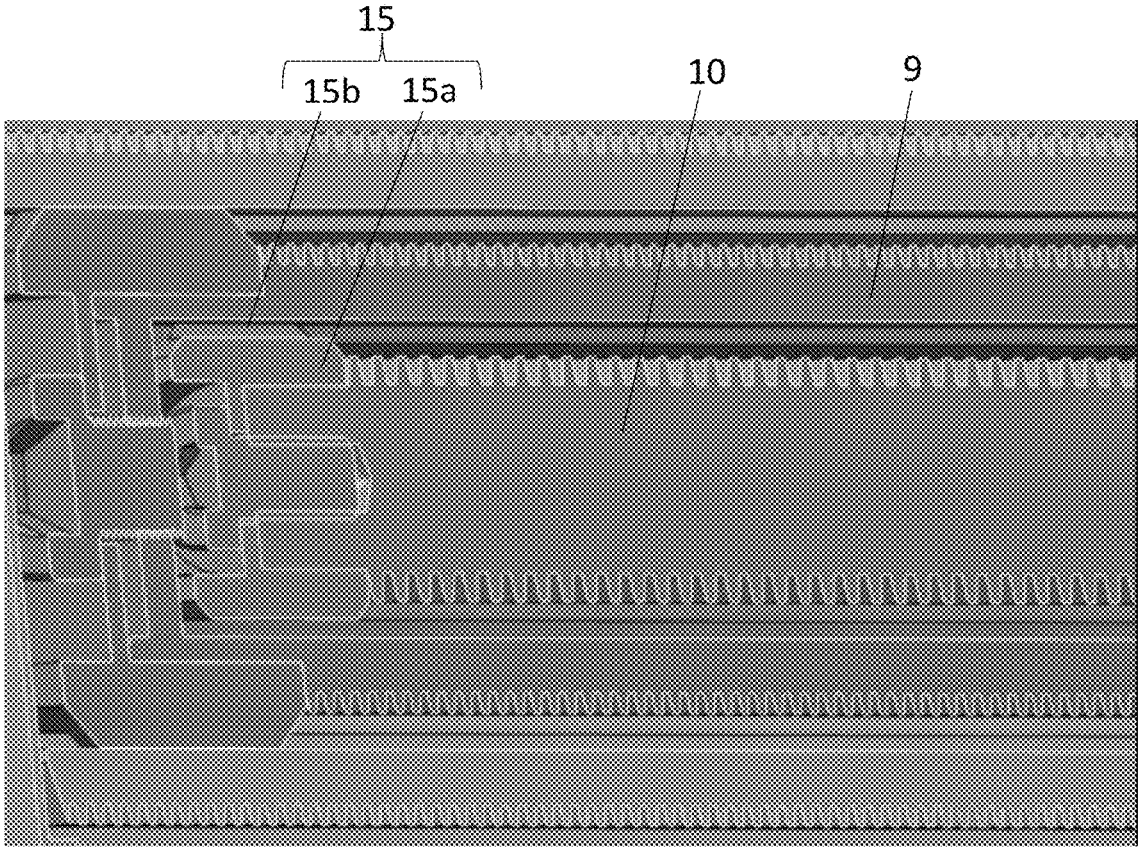
FIG. 8 is a cross-sectional view of the bottom portion of the telescopic leg according to one embodiment of the present disclosure.

Here we will describe the operation of stage B of the telescopic leg 2 initiated by the rotation and vertical movement of the first lead screw 10. FIG. 8 is another cross-sectional view of the telescopic leg 2 that further includes a first cap 15 coupled with one end of the first lead screw 10. In the present embodiment, the first cap 15 has a first cap body 15*a* and has six first cams 15*b* distributed around the outer surface of the first cap body 15*a*. In different embodiments, the first cap 15 can be an integral part of the first lead screw 10 so that the two components are made of the same piece of material.

Figure 9:
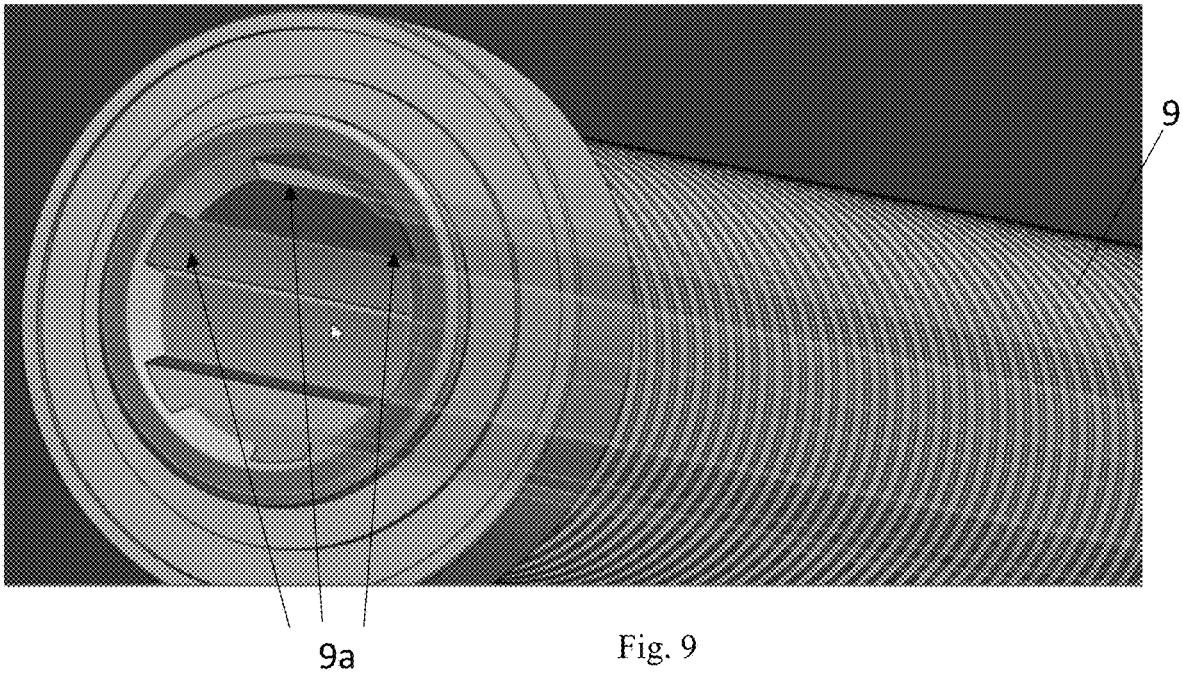
FIG. 9 is a perspective view of the second lead screw according to one embodiment of the present disclosure.

FIG. 9 is a perspective view of the second lead screw 9 having an opening configured to accommodate the first lead screw 10 and the first cap 15 illustrated in FIG. 8. The second lead screw 9 has six longitudinal first grooves 9*a* formed on the inner surface of the second lead screw 9, extending over the length of the second lead screw 9 and configured to accommodate the six first cams 15*b* of the first cap 15.

The purpose of the first cams 15*b* of the first cap 15 and the first grooves 9*a* of the second lead screw 9 is to rotatably coupling the first lead screw 10 with the second lead screw 9. As mentioned above, the first grooves 9*a* extend longitudinal over the length of the second lead screw 9. Firstly, the first cap 15 is attached to the first lead screw 10 and rotates together with the first lead screw 10. As the first lead screw 10 is being rotated by the gear set 12, the first cams 15*b* in the first grooves 9*a* start applying torque on and subsequently rotates the second lead screw 9. The combination of the first cams 15*b* and the first grooves 9*a* ensures that the first and second lead screws 10, 9 rotate in the same direction.

Further, as mentioned above, the first lead nut 7 is attached to one end of the second lead screw 9. Thus, as the rotates first lead screw 10 interacts with the threads on the first lead nut 7 and moves away from the second lead screw 9, the lead screw 10 will reach a point where the first cap 15 can no longer contact the second lead screw 9. This is the point that the combination of the first lead screw 10, second lead screw 9, and first lead nut 7 reaches its maximum length.

Figure 10:
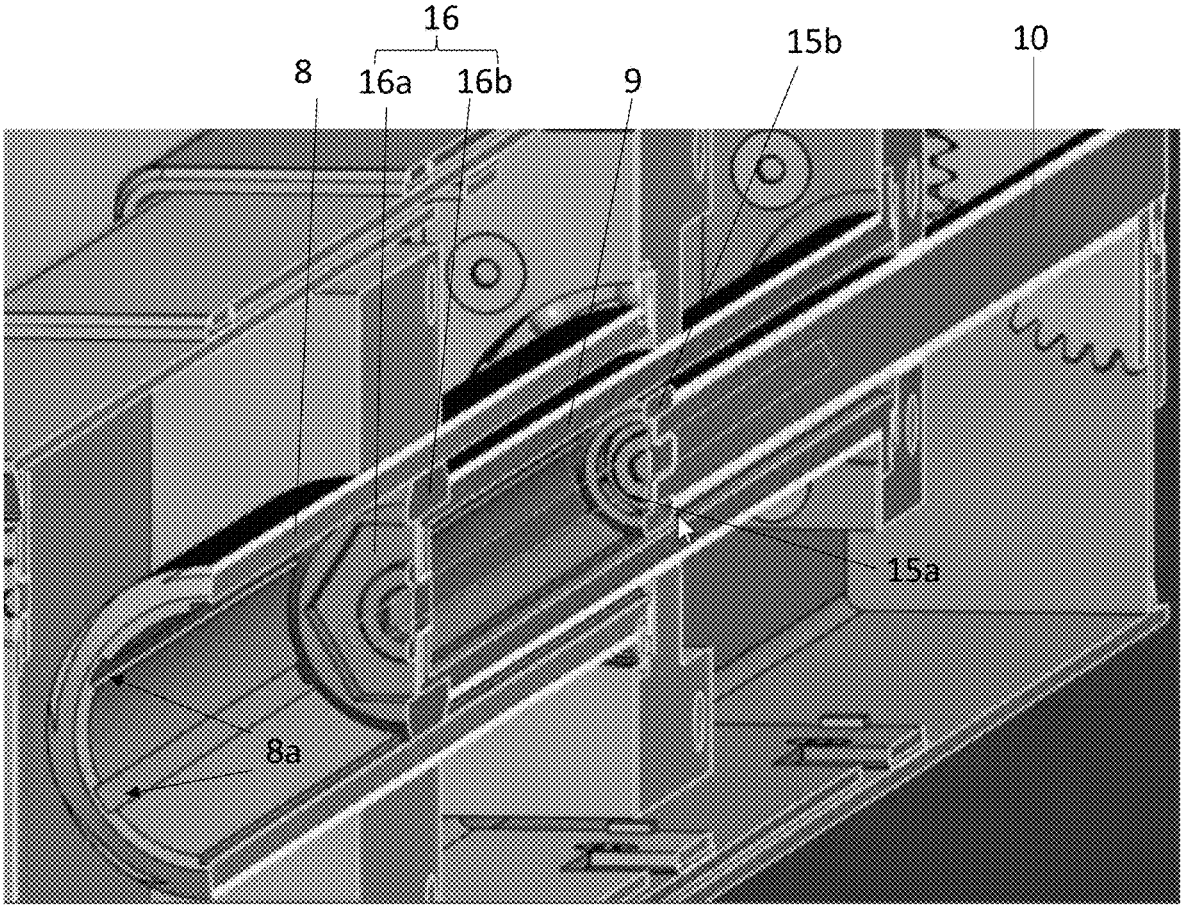
FIG. 10 is a perspective cross-sectional view of the telescopic leg according to one embodiment of the present disclosure.

Here we will discuss stage C of the telescopic leg 2 movement that is initiated by the rotation and vertical movement of the second lead screw 9. FIG. 10 is a perspective cross-sectional view of the telescopic leg 2 according to one embodiment of the present disclosure. The telescopic leg 2 further includes a second cap 16 coupled with one end of the second lead screw 9, wherein the coupling between the second cap 16 and the second lead screw 9 ensures that they rotate in the same direction. The second cap 16 has a second cap body 16*a* and has six second cams 16*b* distributed around the outer surface of the second cap body 16*a*. On the other hand, the third lead screw 8 has six longitudinal second grooves 8*a* formed on the inner surface of the third lead screw 8, extending over the length of the third lead screw 8, and configured to accommodate the six second cams 16*b* of the second cap 16.

The purpose of the second cams 16*b* of the second cap 16 and the second grooves 8*a* of the third lead screw 8 is to rotatably coupling the second lead screw 9 with the third lead screw 8. As mentioned above, the second grooves 8*a* extend longitudinal over the length of the third lead screw 8. Firstly, the second cap 16 is attached to the second lead screw 9 and rotates together with the second lead screw 9. As the second lead screw 9 is being rotated by the first lead screw 10, the second cams 16*b* in the second grooves 8*a* will start applying torque on and subsequently rotates the third lead screw 8. The combination of the second cams 16*b* and the second grooves 8*a* ensures that the second and third lead screws 9, 8 rotate in the same direction.

Here we will describe the operation of stage D of the telescopic leg 2 that involves the rotation and vertical movement of the third lead screw 8. The third lead screw 8 is rotatably coupled with the third lead nut 5 in such a way that the third lead screw 8 can rotate indefinitely without causing the third lead nut 5 to move in any significant manner. Further, the third lead nut 5 serves as the base of the telescopic leg 2 and is thus configured to maintain its position and not be moved or rotated by the rotating third lead screw 8.

In the embodiment discussed above, the threads on the first lead screw 10 and the first lead nut 7 are configured to have a greater lead (travel distance per rotation) than that of the threads on the second lead screw 9 and the second lead nut 6. The greater lead allows the first lead screw 10 to travel more distance, as it's rotated by the motor 11 and the gear set 12, than the second lead screw 9 rotated by the first lead screw 10. In one embodiment, the second and third lead screws 9, 8 can be single start screws while the first lead screw 10 is a multiple start screw which gives the first lead screw 10 a great lead and allows it to travel at a greater rate. In different embodiments, the threads on the first lead screw 10, second lead screw 9, third lead screw 8, first lead nut 7, and second lead nut 6 can be configured to have the same lead so that the lead screw 10, 9, and 8 travel at the same rate.

Figure 11:
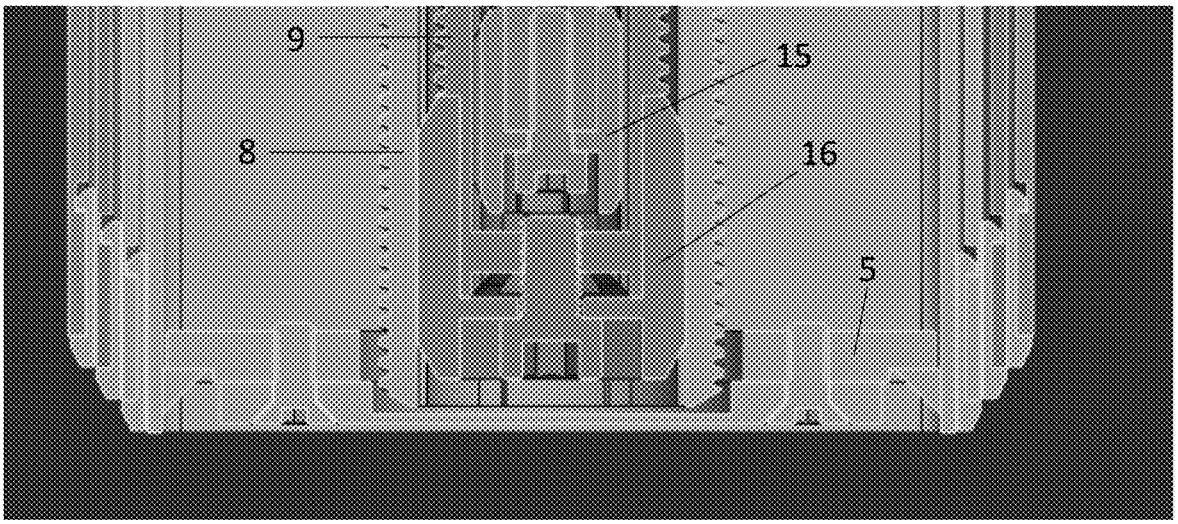
FIG. 11 is another cross-sectional view of the bottom portion of the fully retracted the telescopic leg.

FIG. 11 is a cross-sectional view of a bottom portion of the fully retracted the telescopic leg 2 (also illustrated in FIG. 7). As illustrated in FIG. 11, the third lead nut 5 has an inner space configured to accommodate both of the second and third lead screws' 9, 8 end portions. As mentioned above, one end of the third lead screw 8 is rotatably fixed on the third lead nut 5. On the other hand, when the telescopic leg 2 is fully retracted, part of the second cap 16 enters the inner space of the third lead nut 5. This allows the minimum-attainable height of the telescopic leg 2 to be further reduced by the height of part of the second cap 16 within said inner space.

Figure 12:
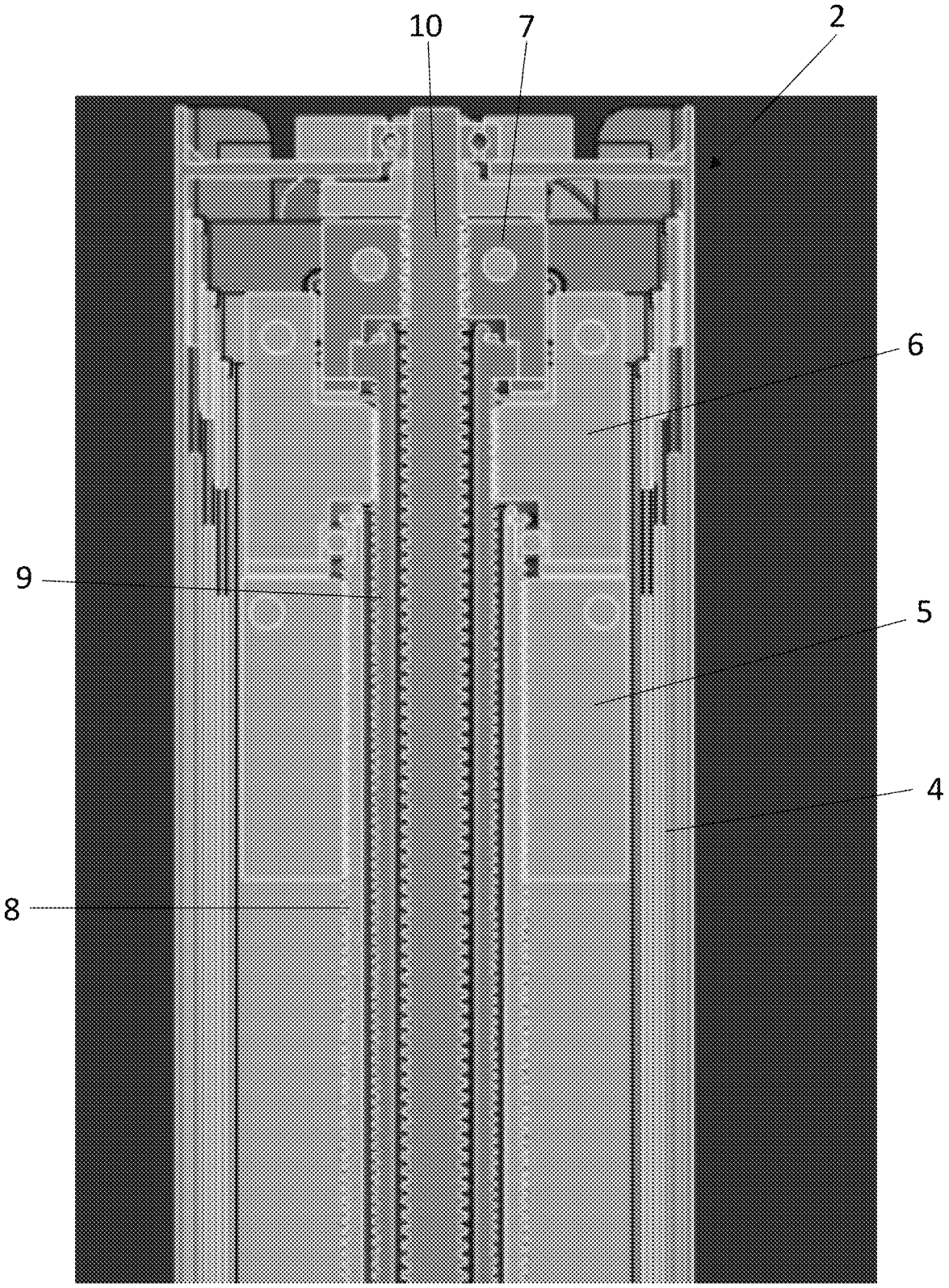
FIGS. 12 and 13 are cross-sectional views of an upper portion of the fully retracted the telescopic leg.
Figure 13:
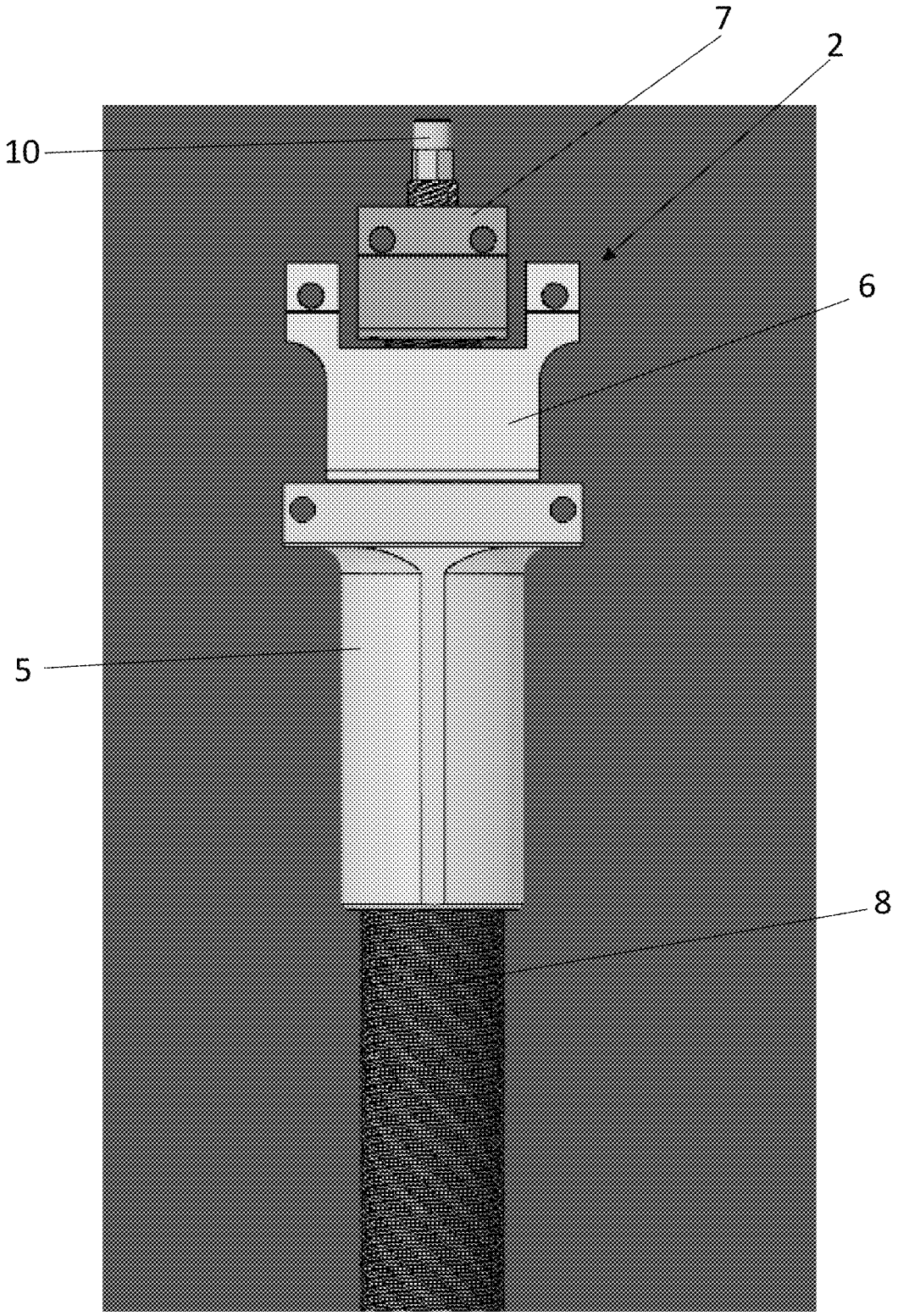

FIG. 12 is a cross-sectional view of an upper portion of the fully retracted telescopic leg 2 (also illustrated in FIG. 7). FIG. 13 is another cross-sectional view of the upper portion of the fully retracted telescopic leg 2 that illustrates the first lead screw 10, the first lead nut 7, the second lead nut 6, the third lead nut 5, and the third lead screw 8. As illustrated in FIGS. 12 and 13, the second lead nut 6 has an upper inner space configured to accommodate at least part of the first lead nut 7. Thus, when the telescopic leg 2 is fully retracted, at least part of the first led nut 7 can move into the upper inner space of the second lead nut 6. Because the lead nuts 6, 7 are at least partially nested, the minimum attainable height of the telescopic leg 2 can be further reduced by the height of the portion of the first lead nut 7 within the second lead nut 6.

The foregoing descriptions of specific implementations have been presented for purposes of illustration and description. They are not intended to be exhaustive or to limit the invention to the precise forms disclosed, and modifications and variations are possible in view of the above teaching. The exemplary implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical and exemplary implementations. It should be recognized that departures may be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

The invention claimed is:

1. A height adjustable desk comprising:

a work surface;

a first telescopic leg attached to the work surface and including:

a motor having a shaft extending vertically upward from the motor;

a gear set having:

a first gear coupled with the shaft of the motor and located above the motor;

a second gear engaged with the first gear and located above the motor, wherein the motor transfers mechanical energy to the second gear through the first gear;

a first rotator engaged with the second gear; and a second rotator engaged with the first rotator, wherein the first rotator is configured to be rotated by the motor through the gear set and translate along a length of the second rotator; wherein the first rotator and the second rotator are located below the second gear, the motor is located below the gear set and next to the first rotator.

2. The height adjustable desk of claim 1, further comprising a first nut connected to one end of the second rotator and having a first inner thread, wherein the first rotator has a first outer thread engaged with the first inner thread, the engagement of the first inner and first outer threads allows the rotated first rotator to move the first nut and the second rotator.

3. The height adjustable desk of claim 1, wherein the second rotator includes a first groove formed longitudinally on an inner surface of the second rotator, the first rotator includes a first cam engaged with the first groove; wherein the rotated first rotator rotates the second rotator through the engagement between the first cam and the first groove.

4. The height adjustable desk of claim 3, wherein the first telescopic leg further includes a third rotator configured to engage with the second rotator, the second rotator rotates the third rotator while translating along a length of the third rotator, wherein the third rotator has a second groove formed longitudinally on an inner surface of the third rotator, the second rotator includes a second cam engaged with the second groove; wherein the rotated second rotator rotates the third rotator through the engagement between the second cam and the second groove.

5. The height adjustable desk of claim 4, further comprising:

a first nut connected to one end of the second rotator and has a first inner thread, wherein the first rotator has a first outer thread engaged with the first inner thread, the engagement of the first inner and first outer threads allows the rotated first rotator to move the first nut and the second rotator; and a second nut connected to one end of the third rotator and has a second inner thread, wherein the second rotator has a second outer thread configured to engage with the second inner thread, the engagement of the second inner and second outer threads allows the rotated second rotator to move the second nut and the third rotator; wherein the first inner thread and the first outer thread have a first thread pitch, the second inner thread and the second outer thread have a second thread pitch.

6. The height adjustable desk of claim 5, wherein the first thread pitch is different from the second thread pitch.

7. The height adjustable desk of claim 1, further comprising a control panel configured to accept user inputs and connected to the motor and configured to turn the motor on or off based on the user inputs, the control panel is configured to regulate power generated by the motor based on the user inputs.

8. The height adjustable desk of claim 1, wherein the gear set further includes a third gear engaged with the first gear and the second, wherein the motor transfers mechanical energy to the second gear through the first gear and the third gear.

9. A telescopic post comprising:

a motor having a shaft extending vertically upward from the motor;

a gear set having:

a first gear coupled with the shaft of the motor and located above the motor;

a second gear engaged with the first gear and located above the motor, wherein the motor transfers mechanical energy to the second gear through the first gear;

a first rotator engaged with the second gear; and a second rotator engaged with the first rotator, wherein the first rotator is configured to be rotated by the motor through the gear set and translate along a length of the second rotator; wherein the first rotator and the second rotator are located below the second gear, the motor is located below the gear set and next to the first rotator.

10. The telescopic post of claim 9, further comprising a first nut connected to one end of the second rotator and having a first inner thread, wherein the first rotator has a first outer thread engaged with the first inner thread, the engagement of the first inner and first outer threads allows the rotated first rotator to move the first nut and the second rotator.

11. The telescopic post of claim 9, wherein the second rotator includes a first groove formed longitudinally on an inner surface of the second rotator, the first rotator includes a first cam engaged with the first groove; wherein the rotated first rotator rotates the second rotator through the engagement between the first cam and the first groove.

12. The telescopic post of claim 11, wherein the first telescopic leg further includes a third rotator configured to engage with the second rotator, the second rotator rotates the third rotator while translating along a length of the third rotator, wherein the third rotator has a second groove formed longitudinally on an inner surface of the third rotator, the second rotator includes a second cam engaged with the second groove; wherein the rotated second rotator rotates the third rotator through the engagement between the second cam and the second groove.

13. The telescopic post of claim 12, further comprising:

a first nut connected to one end of the second rotator and has a first inner thread, wherein the first rotator has a first outer thread engaged with the first inner thread, the engagement of the first inner and first outer threads allows the rotated first rotator to move the first nut and the second rotator; and a second nut connected to one end of the third rotator and has a second inner thread, wherein the second rotator has a second outer thread configured to engage with the second inner thread, the engagement of the second inner and second outer threads allows the rotated second rotator to move the second nut and the third rotator; wherein the first inner thread and the first outer thread have a first thread pitch, the second inner thread and the second outer thread have a second thread pitch.

14. The telescopic post of claim 13, wherein the first thread pitch is different from the second thread pitch.

15. The telescopic post of claim 9, further comprising a control panel configured to accept user inputs and connected to the motor and configured to turn the motor on or off based on the user inputs, the control panel is configured to regulate power generated by the motor based on the user inputs.

16. The telescopic post of claim 9, wherein the gear set further includes a third gear engaged with the first gear and the second, wherein the motor transfers mechanical energy to the second gear through the first gear and the third gear.

17. A telescopic post comprising:

a motor having a shaft extending vertically upward from the motor;

a gear set having:

a first gear connected to the shaft of the motor and located above the motor;

a second gear engaged with the first gear and located above the motor, wherein the motor transfers energy to the second gear through the first gear;

a first rotator configured to engage with the second gear; and a second rotator engaged with the first rotator, wherein the first rotator is configured to be rotated by the motor through the gear set and translate along a length of the second rotator; wherein; and a third rotator configured to engage with the second rotator, the second rotator is configured to be rotated by the motor through the gear set and the first rotator to then translate along a length of the third rotator, the motor is located below the gear set and next to the first rotator.

18. The telescopic post of claim 17, further comprising:

a first nut connected to one end of the second rotator and having a first inner thread, wherein the first rotator has a first outer thread engaged with the first inner thread, the engagement of the first inner and first outer threads allows the rotated first rotator to move the first nut and the second rotator; and a second nut connected to one end of the third rotator and has a second inner thread, wherein the second rotator has a second outer thread configured to engage with the second inner thread, the engagement of the second inner and second outer threads allows the rotated second rotator to move the second nut and the third rotator; wherein the first inner thread and the first outer thread have a first thread lead, the second inner thread and the second outer thread have a second thread lead, the first thread lead is different from the second thread lead.

19. The telescopic post of claim 17, further comprising:

a first nut connected to one end of the second rotator and having a first inner thread, wherein the first rotator has a first outer thread engaged with the first inner thread, the engagement of the first inner and first outer threads allows the rotated first rotator to move the first nut and the second rotator; and a second nut connected to one end of the third rotator and has a second inner thread, wherein the second rotator has a second outer thread configured to engage with the second inner thread, the engagement of the second inner and second outer threads allows the rotated second rotator to move the second nut and the third rotator; wherein the first inner thread and the first outer thread have a first thread lead, the second inner thread and the second outer thread have a second thread lead, the first thread lead and the second thread lead are substantially equal.

20. The telescopic post of claim 17, further comprising:

a first nut connected to one end of the second rotator and having a first inner thread, wherein the first rotator has a first outer thread engaged with the first inner thread, the engagement of the first inner and first outer threads allows the rotated first rotator to move the first nut and the second rotator; and a second nut connected to one end of the third rotator and has a second inner thread, wherein the second rotator has a second outer thread configured to engage with the second inner thread, the engagement of the second inner and second outer threads allows the rotated second rotator to move the second nut and the third rotator; wherein the second nut has an upper inner space configured to accommodate at least part of the first nut, the first nut moves into the upper inner space as the first nut is rotated by the rotated first rotator through the interaction between the first inner thread and the first outer thread.

* * * * *